US010330341B2

(12) United States Patent
Erturk

(10) Patent No.: US 10,330,341 B2
(45) Date of Patent: Jun. 25, 2019

(54) COMBINED TEMPERATURE CONTROL SYSTEM FOR OUTDOOR SPACES

(71) Applicant: Ali C. Erturk, Land-O-Lakes, FL (US)

(72) Inventor: Ali C. Erturk, Land-O-Lakes, FL (US)

( * ) Notice: Subject to any disclaimer, the term of this patent is extended or adjusted under 35 U.S.C. 154(b) by 677 days.

(21) Appl. No.: 15/074,800

(22) Filed: Mar. 18, 2016

(65) Prior Publication Data

US 2016/0273800 A1 Sep. 22, 2016

Related U.S. Application Data

(60) Provisional application No. 62/135,543, filed on Mar. 19, 2015.

(51) Int. Cl.

| | |
|---|---|
| ***F24H 3/00*** | (2006.01) |
| ***F24H 3/02*** | (2006.01) |
| ***F24H 3/04*** | (2006.01) |
| ***F25D 7/00*** | (2006.01) |
| ***F25B 21/00*** | (2006.01) |
| ***F24F 5/00*** | (2006.01) |
| ***F28D 5/00*** | (2006.01) |
| ***F25D 17/06*** | (2006.01) |

(52) U.S. Cl.
CPC ..... *F24H 3/00* (2013.01)

(58) Field of Classification Search
CPC . F24H 3/002; F24H 3/022; F24H 3/04; F24H 3/0405; F24H 3/0411; F24H 3/0417; F24H 3/0423; F24H 3/0429; F24H 3/0452; F24H 3/0458; F24H 3/047; F24H 3/0482; F24H 3/081; F24H 3/082; F25D 7/00; F25D 2317/0682; F25D 17/06; F25D 17/067; F24F 5/0035; F24F 5/00; F25B 21/00; F25B 21/02; F28D 5/00
See application file for complete search history.

(56) References Cited

U.S. PATENT DOCUMENTS

| | | | | |
|---|---|---|---|---|
| 6,298,866 | B1 * | 10/2001 | Molnar, IV | A45B 3/00 108/50.12 |
| 6,422,030 | B1 * | 7/2002 | Calvert | F24F 5/0035 62/310 |
| 8,006,916 | B2 * | 8/2011 | Metcalf | F24F 5/0035 239/128 |
| 8,025,048 | B1 * | 9/2011 | Scarborough | F24C 3/14 126/110 B |
| 8,051,904 | B1 * | 11/2011 | Whiting | B60H 1/00264 165/202 |
| 2003/0164367 | A1 * | 9/2003 | Bucher | F24C 1/14 219/479 |
| 2004/0151484 | A1 * | 8/2004 | Kaplanis | F24C 7/043 392/422 |

(Continued)

*Primary Examiner* — Frantz F Jules
*Assistant Examiner* — Erik Mendoza-Wilkenfel

(57) ABSTRACT

A combined housing for temperature control of a space has a top face, a bottom face, a left side face, a right side face, a front face, and a rear face. A heating assembly formed in the housing has a recess centrally positioned in the front face and a radiant heating element extending laterally within the recess. A cooling assembly formed in the housing has an input aperture formed in the rear face equally spaced from the left and right side faces, a first output aperture formed in the front face between the recess and the left side face, and a right output aperture formed in the front face between the recess and the right side face.

10 Claims, 5 Drawing Sheets

(56) References Cited

U.S. PATENT DOCUMENTS

| | | | | |
|---|---|---|---|---|
| 2005/0276054 | A1* | 12/2005 | Cronin | A47G 1/00<br>362/373 |
| 2008/0169575 | A1* | 7/2008 | Chen | F24F 5/0035<br>261/28 |
| 2011/0248016 | A1* | 10/2011 | Chiu | F24H 3/0411<br>219/477 |
| 2012/0292299 | A1* | 11/2012 | Huang | F24H 3/0411<br>219/209 |
| 2016/0123335 | A1* | 5/2016 | Molnar, IV | F24F 7/007<br>108/28 |

* cited by examiner

FIG. 1
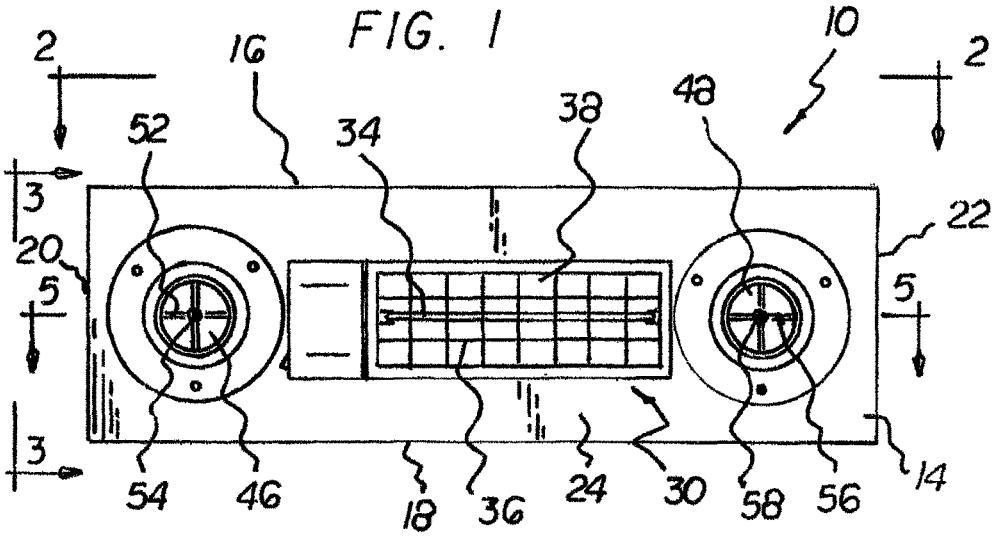
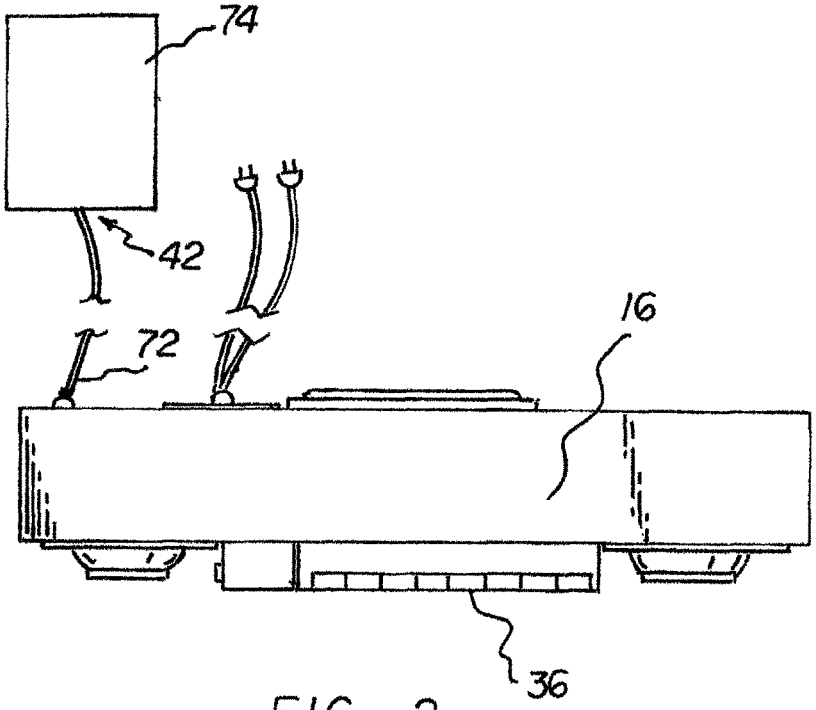
FIG. 2

FIG. 3
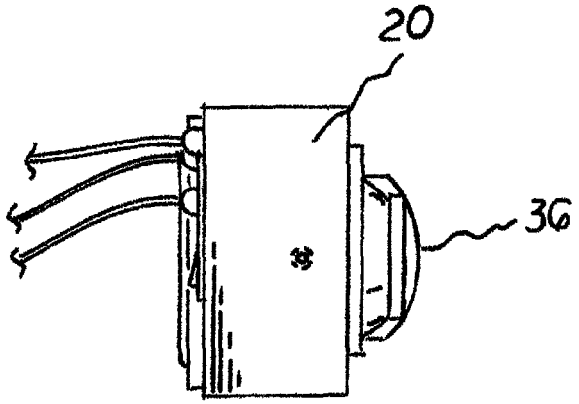
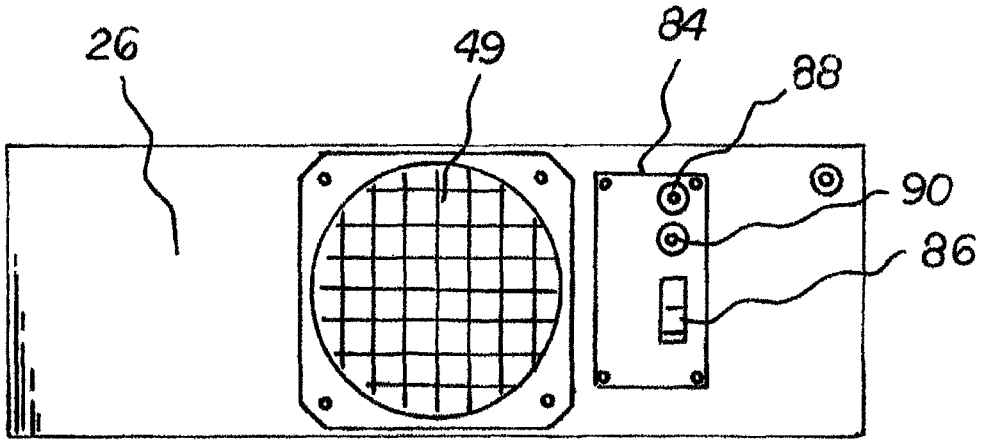
FIG. 4

FIG. 5
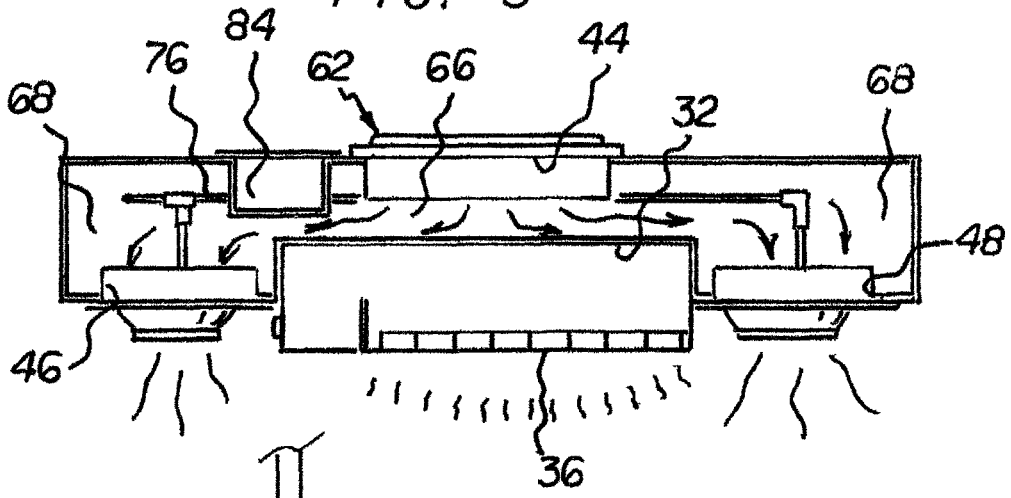
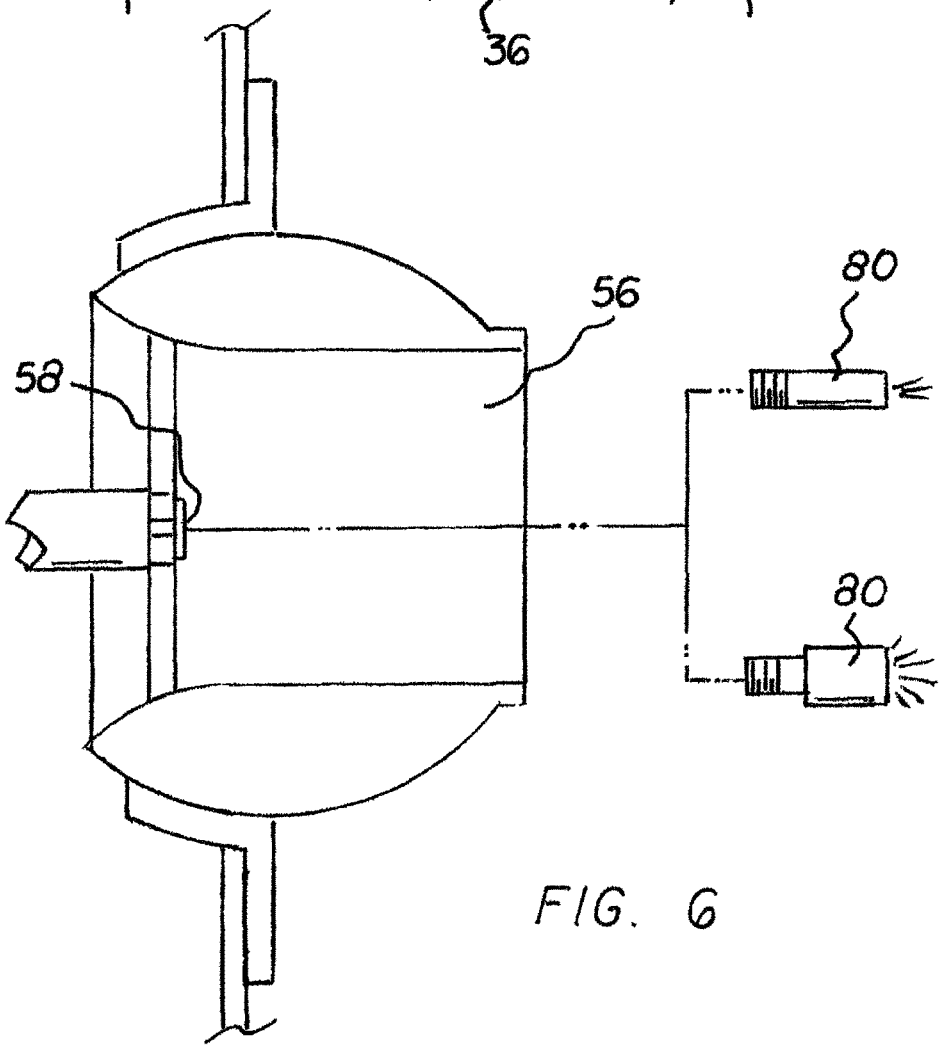
FIG. 6

COMBINED TEMPERATURE CONTROL SYSTEM FOR OUTDOOR SPACES

BACKGROUND OF THE INVENTION

Field of the Invention

The present invention relates to a combined temperature control system for outdoor spaces and more particularly pertains to controlling the heating and the cooling of an outdoor space.

Description of the Prior Art

The use of heaters and coolers is known in the prior art. More specifically, heaters and coolers previously devised and utilized for the purpose of heating and cooling are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a combined temperature control system for outdoor spaces that allows heating and cooling an outdoor space.

In this respect, the combined temperature control system for outdoor spaces according to the present invention substantially departs from the conventional concepts and designs of the prior art, and in doing so provides an apparatus primarily developed for the purpose of heating and cooling an outdoor space.

Therefore, it can be appreciated that there exists a continuing need for a new and improved combined temperature control system for outdoor spaces which can be used for heating and cooling an outdoor space. In this regard, the present invention substantially fulfills this need.

SUMMARY OF THE INVENTION

In view of the foregoing disadvantages inherent in the known types of heaters and coolers now present in the prior art, the present invention provides an improved combined temperature control system for outdoor spaces. As such, the general purpose of the present invention, which will be described subsequently in greater detail, is to provide a new and improved combined temperature control system for outdoor spaces and method which has all the advantages of the prior art and none of the disadvantages.

To attain this, for a broad perspective, the present invention essentially comprises a housing having a top face, a bottom face, a left side face, a right side face, a front face, and a rear face. A heating assembly formed in the housing has a recess centrally positioned in the front face and a radiant heating element extending laterally within the recess. A cooling assembly formed in the housing has an input aperture formed in the rear face equally spaced from the left and right side faces, a first output aperture formed in the front face between the recess and the left side face, and a second output aperture formed in the front face between the recess and the right side face.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is, therefore, an object of the present invention to provide a new and improved combined temperature control system for outdoor spaces which has all of the advantages of the prior art heaters and coolers and none of the disadvantages.

It is another object of the present invention to provide a new and improved combined temperature control system for outdoor spaces which may be easily and efficiently manufactured and marketed.

It is a further object of the present invention to provide a new and improved combined temperature control system for outdoor spaces which is of durable and reliable constructions.

An even further object of the present invention is to provide a new and improved combined temperature control system for outdoor spaces which is susceptible of a low cost of manufacture with regard to both materials and labor, and which accordingly is then susceptible of low prices of sale to the consuming public, thereby making such combined temperature control system for outdoor spaces economically available to the buying public.

Lastly, it is an object of the present invention to provide a combined temperature control system for outdoor spaces for cooling an enlarged outdoor space and for heating an enlarged outdoor space, the cooling and heating being selectively done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of an outdoor combined temperature control system for outdoor spaces constructed in accordance with the principles of the present invention.

FIG. 2 is a plan view of the system taken along line 2-2 of FIG. 1.

FIG. 3 is a side elevational view of the system taken along line 2-2 of FIG. 1.

FIG. 4 is a rear elevational view of the system shown in the prior Figures.

FIG. 5 is a cross sectional view of the system taken along line 5-5 of FIG. 1.

FIG. 6 is an exploded side elevational view of one cooling module and optional spraying and misting nozzles.

The same reference numerals refer to the same parts throughout the various Figures.

DESCRIPTION OF THE PREFERRED EMBODIMENT

Figure 7:
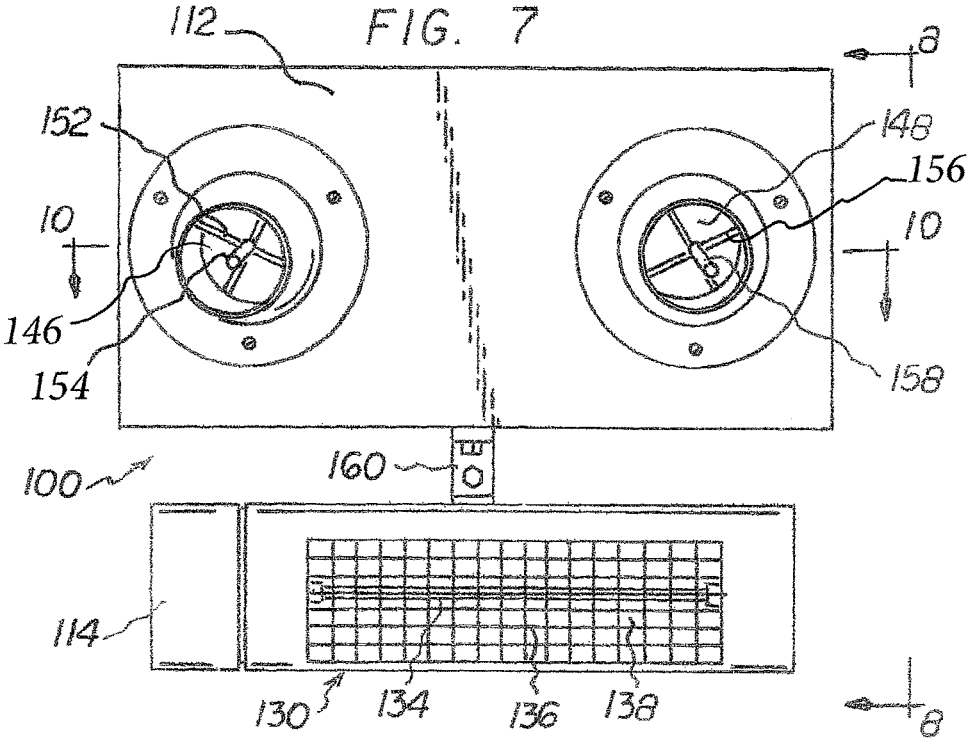
FIG. 7 is a front elevational view of an alternate embodiment of the invention.

With reference now to the drawings, and in particular to FIG. 1 thereof, the preferred embodiment of the new and improved combined temperature control system for outdoor spaces embodying the principles and concepts of the present invention and generally designated by the reference numeral 10 will be described.

The present invention, the combined temperature control system for outdoor spaces 10 is comprised of a plurality of components. Such components in their broadest context include a heating assembly, a cooling assembly, and controls therefor. Such components are individually configured and correlated with respect to each other so as to attain the desired objective.

From a specific perspective, the invention of the present application is With reference now to the drawings, and in particular to FIG. 1 thereof, the preferred embodiment of the combined temperature control system for outdoor spaces embodying the principles and concepts of the present invention and generally designated by the reference numeral 10 will be described.

The present invention, the combined temperature control system for outdoor spaces 10 is comprised of a plurality of components. Such components are individually configured and correlated with respect to each other so as to attain the desired objective. In their broadest context such include a housing, a heating system, and a cooling assembly. From a broad viewpoint, the present invention is a combined temperature control system for outdoor spaces. First provided is a housing. The housing has a top face, a bottom face, a left side face, a right side face, a front face, and a rear face. Also provided is a heating assembly formed in the housing. The heating assembly includes a recess centrally positioned in the front face of the housing. The heating assembly includes a radiant heating element extending laterally within the recess. Further provided is a cooling assembly formed in the housing. The cooling assembly includes an input aperture formed in the rear face. The input aperture is equally spaced from the left side face and the right side face. The cooling assembly includes a first output aperture formed in the front face between the recess and the left side face. The cooling assembly further includes a second output aperture formed in the front face between the recess and the right side face.

From a specific viewpoint, the present invention is a combined temperature control system for outdoor spaces. First provided is a housing 14. The housing is generally rectilinear in configuration. The housing has a top face 16 and a bottom face 18. The top face and the bottom face are imperforate. The top face and the bottom face are horizontally oriented. The top, face and the bottom face are separated by a height. The housing has a left side face 20 and a right side face 22. The left side face and the right side face are imperforate. The left side face and the right side face are vertically oriented. The left side face and the right side face are separated by a width. The housing has a front face 24 and a rear face 26. The front face and the rear face are vertically oriented. The front face and the rear face are separated by a depth.

A heating assembly 30 is provided. The heating assembly is formed in the housing. The heating assembly includes a rectangular recess 32. The recess is centrally positioned in the front face of the housing. The recess has a width between 40 and 60 percent of the width of the housing. The recess has a height between 40 and 60 percent of the height of the housing. The recess has a depth between 40 and 60 percent of the depth of the housing. The heating assembly includes a radiant heating element 34. The radiant heating element extends laterally within the recess. The heating assembly also includes a safety screen 36. The safety screen is forward of the recess in front of the radiant heating element. In this manner injury by touching the radiant heating element is abated. The heating assembly further includes a reflective surface 38. The reflective surface is in the recess behind the radiant heating element. In this manner heat projected from the system is magnified.

A cooling assembly 42 is provided. The cooling assembly is formed in the housing. The cooling assembly includes an input aperture 44. The input aperture is formed in the rear face equally spaced from the left side face and the right side face. The cooling assembly includes output apertures. The output apertures include a left output aperture 46 and a right output aperture 48. The left output aperture is formed in the front face between the left side face and the recess. The right output aperture is formed in the front face between the right side face and the recess. The cooling system includes left directional vanes 52 with a removable left central nozzle 54 in the left output aperture. The cooling assembly further includes right directional vanes 56 with a removable right central nozzle 58 in the right output aperture.

Provided next is an air delivery assembly 62. The air delivery system includes a fan 64. The fan is operatively coupled to the input aperture. The air delivery assembly includes a primary air path 66 of a restricted passageway between the input aperture and the recess. The air delivery assembly further includes secondary air paths 68 of an expanded passageway between the output apertures and the primary air path.

Also provided is a coolant delivery assembly 72. The coolant delivery assembly includes a coolant source 74. The coolant delivery assembly further includes coolant lines 76. The coolant lines couple the nozzles to the coolant source.

Further provided are supplemental nozzles 80. The supplemental nozzles are optionally positionable in the left output aperture and the right output aperture replacing the left central nozzle and the right central nozzle. The supplemental nozzles optionally, in this manner, project cooling vapor and/or mist.

Provided last is a control assembly 84. The control assembly has an OFF/ON switch 86. The control assembly has a first power line 88. In this manner the operation of the fan is controlled. The control assembly includes a second power line 90. In this manner operation of the heating assembly is controlled. The control assembly further includes and an inlet 92 for the coolant. Such components are individually configured and correlated with respect to each other so as to attain the desired objective. The coolant delivery is separately controlled.

Figure 8:
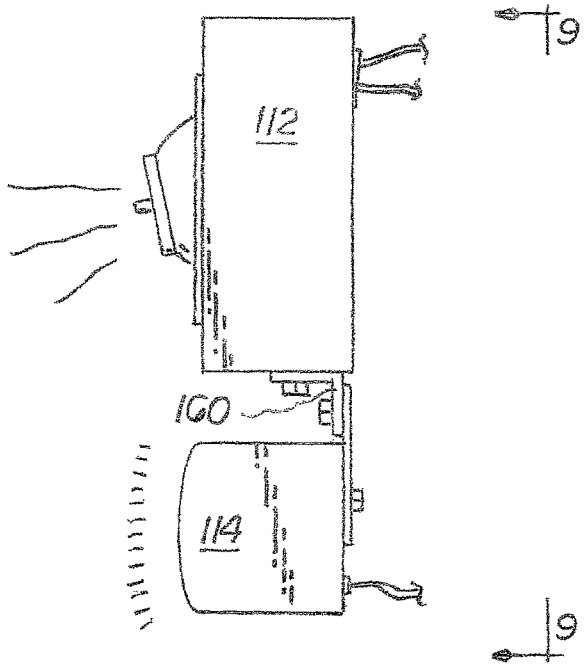
FIG. 8 is a left side elevational view taken along line 8-8 of FIG. 7.
Figure 9:
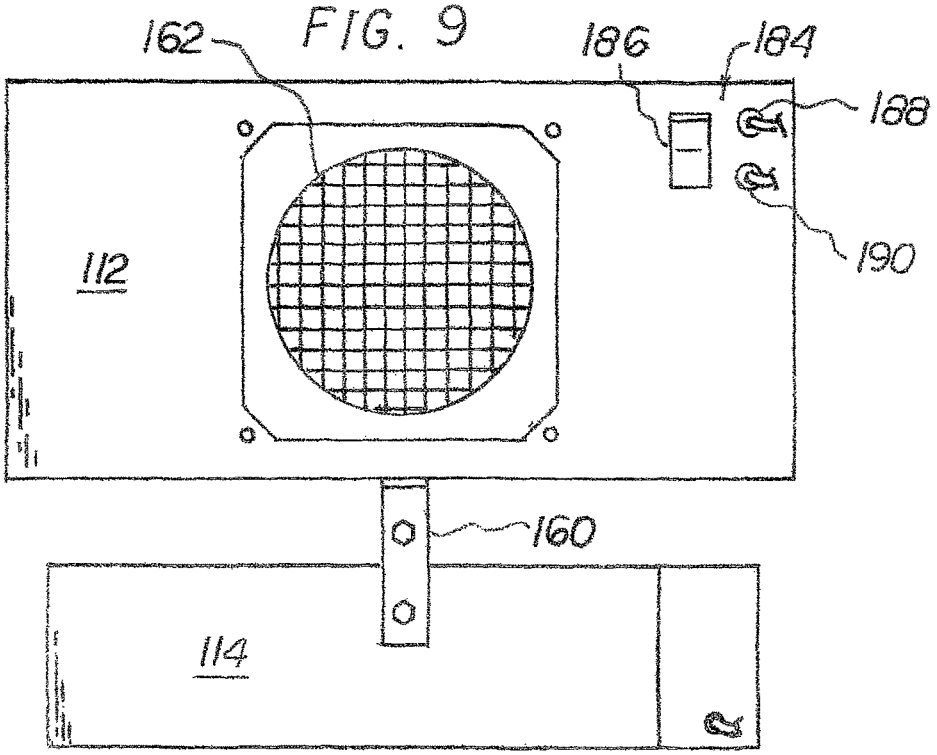
FIG. 9 is a rear elevational view taken along line 9-9 of FIG. 8.
Figure 10:
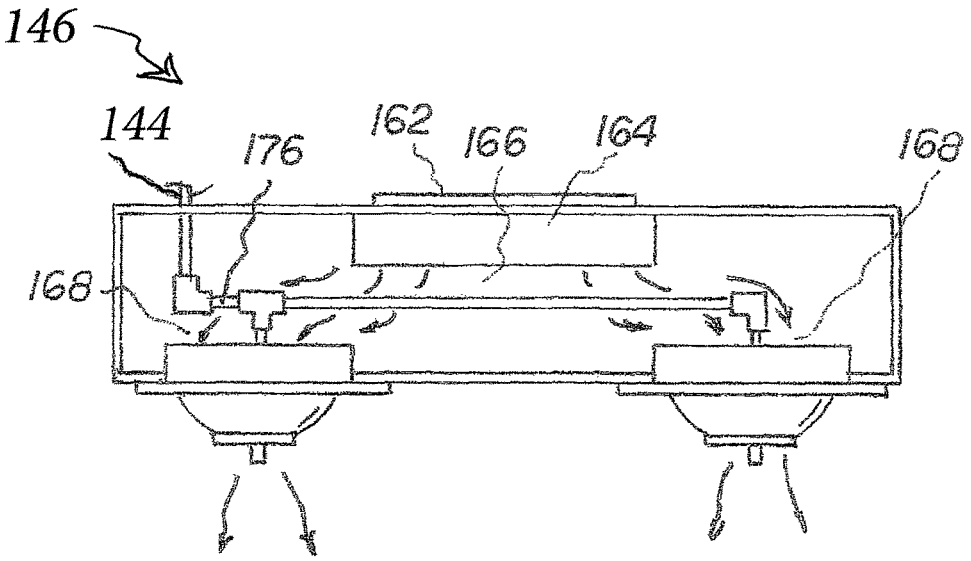
FIG. 10 is a cross sectional view taken along line 10-10 of FIG. 7.

An alternate embodiment of the intention is illustrated in FIGS. 7 through 10. In such alternate embodiment, the combined temperature control system for outdoor spaces 100 is comprised of a plurality of components. Such components are individually configured and correlated with respect to each other so as to attain the desired objectives. The system of this embodiment is an outdoor temperature control system 100 for cooling an enlarged outdoor space and for heating an enlarged outdoor space. The cooling and heating is selectively done in a safe, convenient, and economical manner.

In this alternate embodiment, the system comprises an upper housing 112 in a generally rectilinear configuration having a top face and a bottom face. The top face and the bottom face are imperforate. The top face and the bottom face are horizontally oriented and separated by a height. The upper housing has a left side face and a right side face. The left side face and the right side face are imperforate. The left side face and the right side face are vertically oriented and separated by a width. The upper housing has a front face and a rear face. The front face and the rear face are vertically oriented and separated by a depth.

Next provided is a lower housing 114 in a generally rectilinear configuration having a top face and a bottom face. The top face and the bottom face are imperforate. The top face and the bottom face are horizontally oriented and separated by a height. The lower housing has a left side face and right side face. The left side face and the right side face are imperforate. The left side face and the right side face are vertically oriented and are separated by a width. The lower housing has a front face and a rear face. The front face and the rear face are vertically oriented and separated by a depth.

A heating assembly 130 is next provided. The heating assembly is formed in the lower housing. The heating assembly includes a rectangular recess centrally positioned in the front face of the lower housing. The recess has a width between 80 and 90 percent of the width of the lower housing. The recess has a height between 40 and 60 percent of the height of the lower housing. A radiant heating element 134 extends laterally within the recess. A safety screen 136 extends forward of the recess in front of the radiant heating element to abate injury occurring by touching the radiant heating element. A reflective surface 138 in the recess behind the radiant heating element magnifies heat projected from the system.

Next, a cooling assembly 142 is provided. The cooling assembly is formed in the upper housing. The cooling assembly includes an input aperture 144 formed in the rear face. The cooling assembly includes output apertures. The output apertures include a left output aperture 146 and a right output aperture 148. The left output aperture is formed in the front face adjacent the left side face. The right output aperture 148 is formed in the front face adjacent the right side face. Left directional vanes 152 with a removable left central nozzle 154 are provided in the left output aperture. Right directional vanes 156 with a removable right central nozzle 158 are provided in the right output aperture.

A bracket 160 secures the lower housing beneath the upper housing. The height of the lower housing is between 40 percent and 60 percent of the height of the upper housing.

An air delivery assembly 162 includes a fan 164 operatively coupled to the input aperture. The air delivery assembly includes a primary air path 166 of a restricted passageway between the input aperture and the recess. The air delivery assembly includes secondary air paths 168 of an expanded passageway between the output apertures and the primary air path.

Next, a coolant delivery assembly is provided. The coolant delivery assembly includes a coolant source. Coolant lines 176 couple the nozzles to the coolant source.

Supplemental nozzles are provided. Optionally, the supplemental nozzles replace the left central nozzle and the right central nozzle positioned in the left output aperture and the right output aperture. In this manner, the supplemental nozzles project cooling vapor and/or mist.

Lastly, a control assembly 184 has an OFF/ON switch 186. A first power line 188 controls the operation of the fan. A second power line 190 controlling the operation of the heating assembly. Supplemental downwardly directed additional heating elements which may be provided to accommodate locations of grater coldness.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A combined temperature control system for spaces comprising:

a housing having a top face, a bottom face, a left side face, a right side face, a front face, and a rear face;

a heating assembly comprising a recess centrally located on the front face of the housing, the heating assembly further including a radiant heater extending laterally within the recess; and a cooling assembly formed in the housing including an input aperture formed in the rear face equally spaced from the left side face and the right side face, a first output aperture formed in the front face between the recess and the left side face, and a second output aperture formed in the front face between the recess and the right side face.

2. The system as set forth in claim 1 wherein the housing is a single component containing both the heating assembly and the cooling assembly.

3. The system as set forth in claim 2 and further including:

an air delivery assembly including a fan operatively coupled to the input aperture, a primary air path of a restricted passageway between the input aperture and the recess, and secondary air paths, each secondary air path having an expanded passageway between the output apertures and the primary air path.

4. The system as set forth in claim 2 and further including:

a coolant delivery assembly including a coolant source and coolant lines coupling the coolant source to the first output aperture and the second output aperture.

5. The system as set forth in claim 4 and further including:

supplemental nozzles positionable in the first output aperture and the second output aperture whereby coolant projected by the nozzles provides cooling through mist and the like.

6. The system as set forth in claim 1 wherein:

the housing includes an upper component and a lower component, the upper component containing the cooling assembly and the lower component containing the heating assembly; and the system further includes a bracket securing the lower component beneath the upper component.

7. The system as set forth in claim 6 wherein the height of the lower component is between 40 percent and 60 percent of the height of the upper component.

8. A combined outdoor temperature control system (10) for cooling and heating an outdoor space the combined temperature control system comprising:

a housing (14) in a generally rectilinear configuration having a top face (16) and a bottom face (18), the top face and the bottom face being imperforate and horizontally oriented and separated by a height, the housing having a left side face (20) and a right side face (22), the left side face and the right side face being imperforate and vertically oriented and separated by a width, the housing having a front face (24) and a rear face (26), the front face and the rear face being vertically oriented and separated by a depth;

a heating assembly (30) located in a rectangular recess (32) centrally positioned in the front face of the housing, the recess having a width between 40 and 60 percent of the width of the housing, the recess having a height between 40 and 60 percent of the height of the housing, the recess having a depth between 40 and 60 percent of the depth of the housing, a radiant heater (34) extending laterally within the recess, a safety screen (36) extending forward of the recess in front of the radiant heater to abate injury by touching the radiant heater, a reflective surface (38) in the recess behind the radiant heater to magnify heat projected from the system;

a cooling assembly (42) formed in the housing, the cooling assembly including an input aperture (44) formed in the rear face equally spaced from the left side faces and the right side face, the cooling assembly including output apertures, the output apertures including a left output aperture (46) formed in the front face between the left side face and the recess, the output apertures also including a right output aperture (48) formed in the front face between the right side face and the recess, left directional vanes (52) with a removable left central nozzle (54) in the left output aperture, right directional vanes (56) with a removable right central nozzle (58) in the right output aperture;

an air delivery assembly (62) including a fan (64) operatively coupled to the input aperture, the air delivery assembly including a primary air path (66) of a restricted passageway between the input aperture and the recess, the air delivery assembly including a secondary air path (68) of an expanded passageway between the output apertures and the primary air path;

a coolant delivery assembly (72) including a coolant source (74) and coolant lines (76) coupling the left central and right central nozzles to the coolant source; and a control assembly (84) having an OFF/ON switch (86), a first power line (88) controlling the operation of the fan, a second power line (90) controlling the operation of the coolant delivery assembly, and an inlet (92) for the coolant.

9. The system as set forth in claim 8 wherein the system further includes supplemental nozzles (80), the supplemental nozzles positionable in the left output aperture and the right output aperture in stead of the left central nozzle and right central nozzle whereby coolant projected by the supplemental nozzles provides a cooling vapor.

10. A combined temperature control system (100) for cooling and heating an outdoor space the combined temperature control system comprising:

an upper housing (112) in a generally rectilinear configuration having a top face and a bottom face, the top face and the bottom face being imperforate and horizontally oriented and separated by a height, the housing having a left side face and a right side face, the left side face and the right side face being imperforate and vertically oriented and separated by a width, the upper housing having a front face and a rear face, the front face and the rear face being vertically oriented and separated by a depth;

a lower housing (114) in a generally rectilinear configuration having a top face and a bottom face, the top face and the bottom face being imperforate and horizontally oriented and separated by a height, the lower housing having a left side face and right side face, the left side face and the right side face being imperforate and vertically oriented and separated by a width, the lower housing having a front face and a rear face, the front face and the rear face being vertically oriented and separated by a depth;

a heating assembly (130) formed in the lower housing, the heating assembly including a rectangular recess centrally positioned in the front face of the lower housing, the recess having a width between 80 and 90 percent of the width of the lower housing, the recess having a height between 40 and 60 percent of the height of the lower housing, a radiant heater (134) extending laterally within the recess, a safety screen (136) extending forward of the recess in front of the radiant heater to abate injury by touching the radiant heater, a reflective surface (138) in the recess behind the radiant heater to magnify heat projected from the system;

a cooling assembly (142) formed in the upper housing, the cooling assembly including an input aperture (144) formed in the rear face, the cooling assembly including output apertures, the output apertures including a left output aperture (146) formed in the front face adjacent the left side face, the output apertures including a right output aperture (148) formed in the front face adjacent the right side face, left directional vanes (152) with a removable left central nozzle (154) in the left output aperture, right directional vanes (156) with a removable right central nozzle (158) in the right output aperture;

a bracket (160) securing the lower housing beneath the upper housing wherein the height of the lower housing is between 40 percent and 6o percent of the height of the upper housing;

an air delivery assembly (162) including a fan (164) operatively coupled to the input aperture, a primary air path (166) of a restricted passageway between the input aperture and the recess, a secondary air path (168) of an expanded passageway between the output apertures and the primary air path;

a coolant delivery assembly including a coolant source and coolant lines (176) coupling the right central nozzle and the left central nozzle to the coolant source; and a control assembly (184) having an OFF/ON switch (186) and a first power line (188) controlling the operation of the fan and a second power line (190) controlling the operation of the heating assembly.

* * * * *